US006035673A

United States Patent [19]

Harrison

[11] Patent Number: 6,035,673

[45] Date of Patent: Mar. 14, 2000

[54] SLIDING DOOR LOCK WITH A KEY REMOVABLE CORE

[75] Inventor: Robert B. Harrison, Northport Village, N.Y.

[73] Assignee: Kenstan Lock Company, Plainview, N.Y.

[21] Appl. No.: 09/172,483

[22] Filed: Oct. 14, 1998

Related U.S. Application Data

[60] Provisional application No. 60/066,031, Nov. 14, 1997.

[51] Int. Cl.[7] ..... E05B 65/08

[52] U.S. Cl. ..... 70/100; 70/373; 70/369; 70/371

[58] Field of Search ..... 70/367, 371, 373, 70/451, 369, 100

[56] References Cited

U.S. PATENT DOCUMENTS

| | | | |
|---|---|---|---|
| 2,814,941 | 12/1957 | Best | 70/369 |
| 3,019,633 | 2/1962 | Russell et al. | 70/224 |
| 3,206,958 | 9/1965 | Best | 70/369 |
| 3,261,189 | 7/1966 | Best | 70/369 |
| 3,298,211 | 1/1967 | Russell et al. | 70/369 |
| 3,324,693 | 6/1967 | Check | 70/369 |
| 3,434,316 | 3/1969 | Neary | 70/371 |
| 3,603,123 | 9/1971 | Best | 70/364 |
| 3,667,264 | 6/1972 | Surko, Jr. et al. | 70/369 |
| 3,713,311 | 1/1973 | Oliver et al. | 70/369 |
| 3,715,899 | 2/1973 | McCullum | 70/369 |
| 3,728,879 | 4/1973 | Best | 70/38 R |
| 3,824,817 | 7/1974 | Orr | 70/81 |
| 4,123,926 | 11/1978 | Elder | 70/369 |
| 4,191,037 | 3/1980 | Patriquin | 70/369 |
| 4,195,504 | 4/1980 | Foshee | 70/369 |
| 4,272,975 | 6/1981 | Patriquin | 70/369 |
| 4,294,093 | 10/1981 | Best et al. | 70/369 |
| 4,328,690 | 5/1982 | Oliver | 70/369 |
| 4,386,510 | 6/1983 | Best et al. | 70/369 |
| 4,398,405 | 8/1983 | Patriquin | 70/369 |
| 4,424,693 | 1/1984 | Best et al. | 70/369 |
| 4,444,034 | 4/1984 | Best et al. | 70/369 |
| 4,539,828 | 9/1985 | Teleky | 70/369 |
| 4,630,457 | 12/1986 | Kincaid et al. | 70/369 |
| 4,633,690 | 1/1987 | Foshee | 70/451 |
| 4,704,880 | 11/1987 | Schlindwein | 70/120 |
| 4,715,201 | 12/1987 | Craig | 70/369 |
| 4,722,204 | 2/1988 | Foshee | 70/100 |
| 4,761,978 | 8/1988 | Walla | 70/367 |
| 4,763,496 | 8/1988 | Evans et al. | 70/38 A |
| 4,768,360 | 9/1988 | Foshee | 70/100 |
| 4,899,563 | 2/1990 | Martin | 70/367 |
| 4,914,932 | 4/1990 | Walla | 70/367 |
| 4,953,373 | 9/1990 | Toledano | 70/369 |
| 4,976,123 | 12/1990 | Ceron et al. | 70/369 |
| 4,995,249 | 2/1991 | Preissler et al. | 70/224 |
| 5,010,753 | 4/1991 | Boris, Jr. | 70/371 |
| 5,070,715 | 12/1991 | Smallegan et al. | 70/369 |
| 5,119,654 | 6/1992 | Ceron et al. | 70/369 |
| 5,121,618 | 6/1992 | Scott | 70/367 |
| 5,121,619 | 6/1992 | Martin | 70/371 |
| 5,226,304 | 7/1993 | Scott | 70/369 |
| 5,233,851 | 8/1993 | Florian | 70/367 |
| 5,272,895 | 12/1993 | Best | 70/369 |
| 5,291,767 | 3/1994 | Weindorf, Jr. et al. | 70/370 |
| 5,317,889 | 6/1994 | Solovieff et al. | 70/224 |
| 5,375,444 | 12/1994 | Smith | 70/495 |
| 5,398,531 | 3/1995 | Shen | 70/224 |
| 5,421,179 | 6/1995 | Bergström | 70/369 |
| 5,507,163 | 4/1996 | Juang | 70/369 |
| 5,606,882 | 3/1997 | Larsen et al. | 70/369 |
| 5,813,260 | 9/1998 | Widen | 70/369 |
| 5,873,272 | 2/1999 | Thompson | 70/100 |

*Primary Examiner*—Darnell M. Boucher
*Assistant Examiner*—John B. Walsh
*Attorney, Agent, or Firm*—Dilworth & Barrese

[57] ABSTRACT

A sliding door lock assembly having a lock housing and a removable core is disclosed. The removable core includes a key slot configured to receive an operating key and a control key. The control key is positionable within the key slot and actuable to facilitate removal of the removable core from the lock housing. The operating key positionable within the key slot and actuable to retain the removable core at a position fully inserted within the lock housing.

15 Claims, 6 Drawing Sheets

SLIDING DOOR LOCK WITH A KEY REMOVABLE CORE

This application claims priority from provisional application Serial No. 60/066,031 filed Nov. 14, 1997 entitled, SLIDING DOOR LOCK WITH A KEY REMOVABLE CORE, which is hereby incorporated by reference.

BACKGROUND

1. Technical Field

The present disclosure relates generally to a lock for sliding doors. More specifically, the present disclosure relates to a lock for sliding doors including a lock housing and an interchangeable lock core.

2. Background of Related Art

Locks for sliding doors including a housing and a removable core are well known in the art. Typically, sliding door locks include a lock housing that is mountable in a first sliding door and a lock core slidably mounted within a bore formed in the lock housing. The lock core is slidable from a first position located within the lock housing bore to a second position extending from the lock housing bore to prevent movement of a second sliding door relative to the first sliding door.

One such sliding door lock is illustrated in prior art FIGS. 1 and 2 and shown generally as 10. Sliding door lock 10 includes a lock housing 12 having a bore 14 formed therein and a cylindrical body portion 15 configured to be received within an opening in sliding door 18. A removable lock core 16 is slidably positioned within bore 14. Lock housing 12 is secured to sliding door 18 by a clamp plate 20 using screws 22. A side bar 24 is rotatable from a position preventing movement of lock core 16 within bore 14 to a position allowing movement of the core 16 within bore 14. Side bar 24 is rotatable by inserting an control key (not shown) into a key slot 26 and turning the key. A fillister head retaining screw 28 is secured to the end of lock core 16 opposite key slot 26. Fillister head retaining screw 28 prevents removal of lock core 16 from lock housing 12, but may be removed to separate core 16 from housing 12.

One problem associated with the prior art sliding door lock illustrated in FIGS. 1 and 2 is that access to fillister head retaining screw 28 is limited and may require removal of sliding door 18 from a cabinet on which it is positioned. Consequently, removal of lock core 16 from lock housing 12 may require a considerable amount of time and effort. A second problem associated with sliding door lock 10 is that the cylindrical body portion 15 has a tendency to rotate clockwise or counter-clockwise relative to the opening formed in sliding door 18 when screws 22 become loosened requiring two hands to insert a key and operate the lock, i.e., one hand to grip lock housing 12 and one hand to turn the key. Tightening screws 22 once again may require removal of sliding door 18 requiring considerable time and effort.

Accordingly, a need exists for an improved sliding door lock adapted to be rotatably fixed with respect to a sliding door to which it is attached and having an easily removable lock core. Further, a need exists for an improved sliding door lock which can be manufactured easily and cost effectively.

SUMMARY

In accordance with the present disclosure, a sliding door lock assembly is provided having a key removable core. The sliding door lock assembly includes a lock housing and a removable lock core. The lock housing has a cylindrical portion having a pair of flats configured to be received in an opening formed in a sliding door. The flats prevent rotation of the lock housing relative to the sliding door. The lock housing also includes a throughbore having a pair of abutment surfaces.

The removable lock core has a figure-8 configuration and includes a core body having a slot to accommodate a rotatable side bar. A rotatable retaining member is secured to the rear end of the core body. The forward end of the core body includes a key slot configured to receive an operating key and a control key.

During use, the control key is insertable into the key slot to rotate the side bar between a first position located within the slot to a second position extending from the slot. In the second position, an engagement member formed on the side bar is aligned with one of the abutment surfaces such that the removable core is slidable along the throughbore but is prevented from being removed from the throughbore. In the first position, the core can be removed from the throughbore. The operating key is insertable into the key slot to rotate the retaining member. The retaining member includes an engagement surface which is rotatable from a first position spaced from the other abutment surface to a second position aligned with the abutment surface. In the second position, the removable core is prevented from sliding along the throughbore.

BRIEF DESCRIPTION OF THE DRAWINGS

Various preferred embodiments are described herein with reference to the drawings, wherein.

DETAILED DESCRIPTION OF PREFERRED EMBODIMENTS

Figure 1:
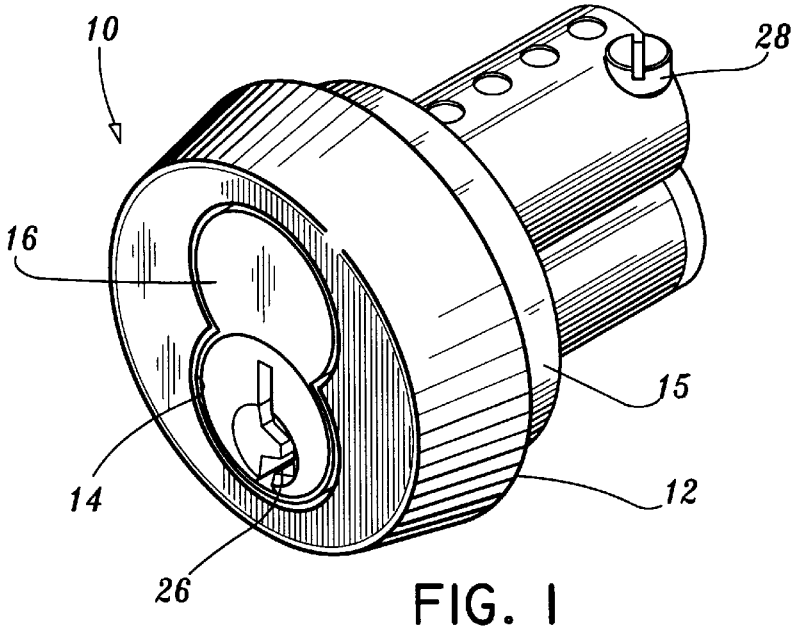
FIG. 1 PRIOR ART
FIG. 1 is a front perspective view of a prior art sliding door lock assembly.
Figure 2:
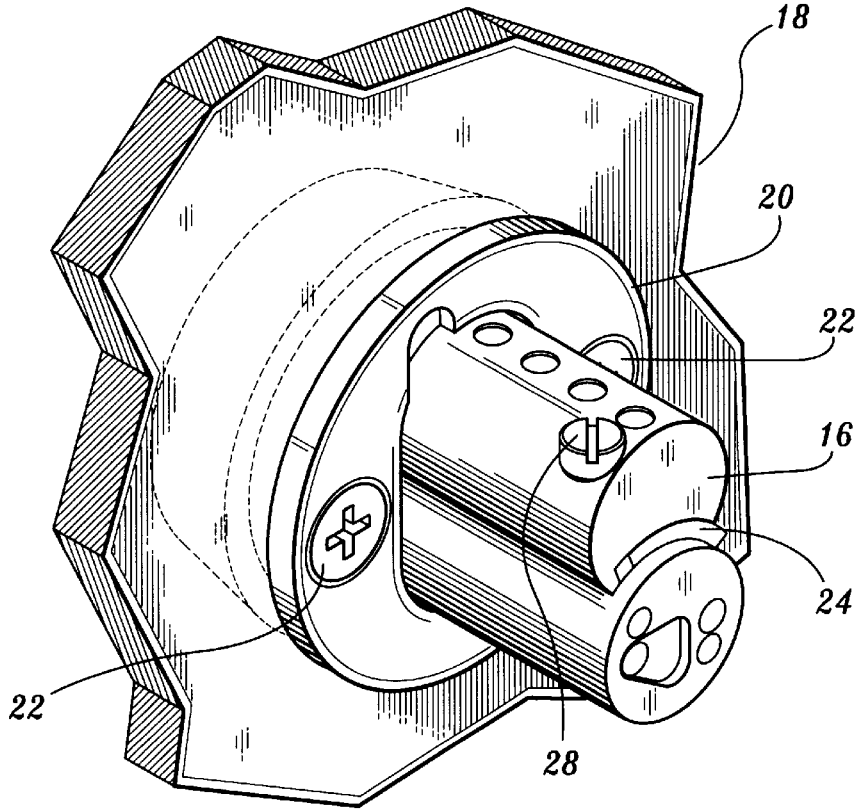
FIG. 2 PRIOR ART
FIG. 2 is a rear perspective view of the prior art sliding door lock assembly shown in FIG. 1 secured to a sliding door.

Preferred embodiments of the presently disclosed sliding door lock assembly will be described in detail with reference to the drawings, in which like reference numerals designate identical or corresponding elements in each of the several views.

Figure 3:
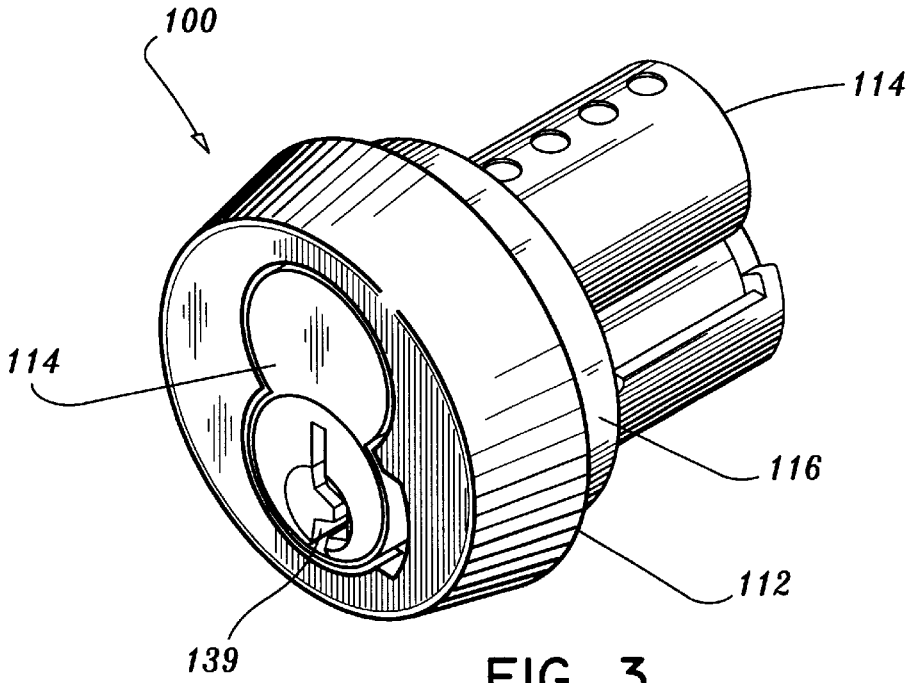
FIG. 3 is a front perspective view of one embodiment of the sliding door lock assembly of the present disclosure.

FIGS. 3–8 illustrate one embodiment of the presently disclosed sliding door lock assembly having a key removable core shown generally as 100 in FIG. 3. Briefly, sliding door lock assembly 100 includes a lock housing 112 and an interchangeable lock core 114.

Figure 4:
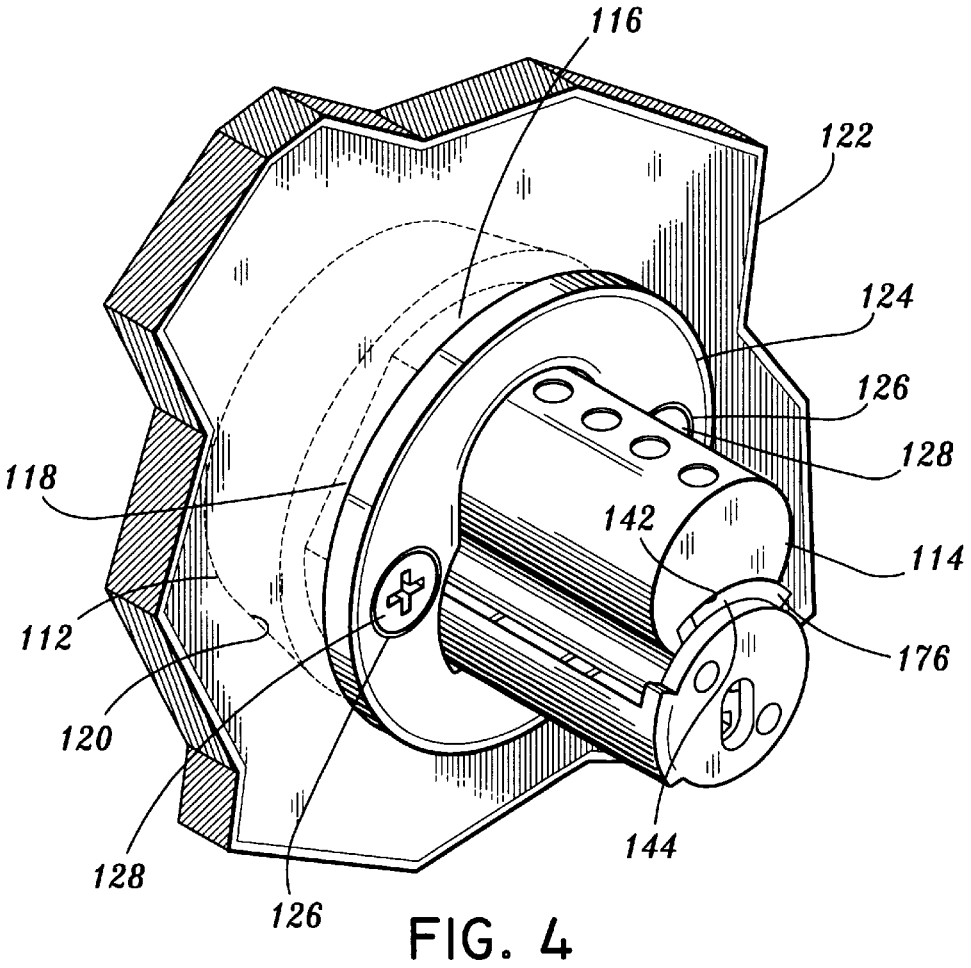
FIG. 4 is a rear perspective view of the sliding door lock assembly shown in FIG. 3 secured to a sliding door.
Figure 5:
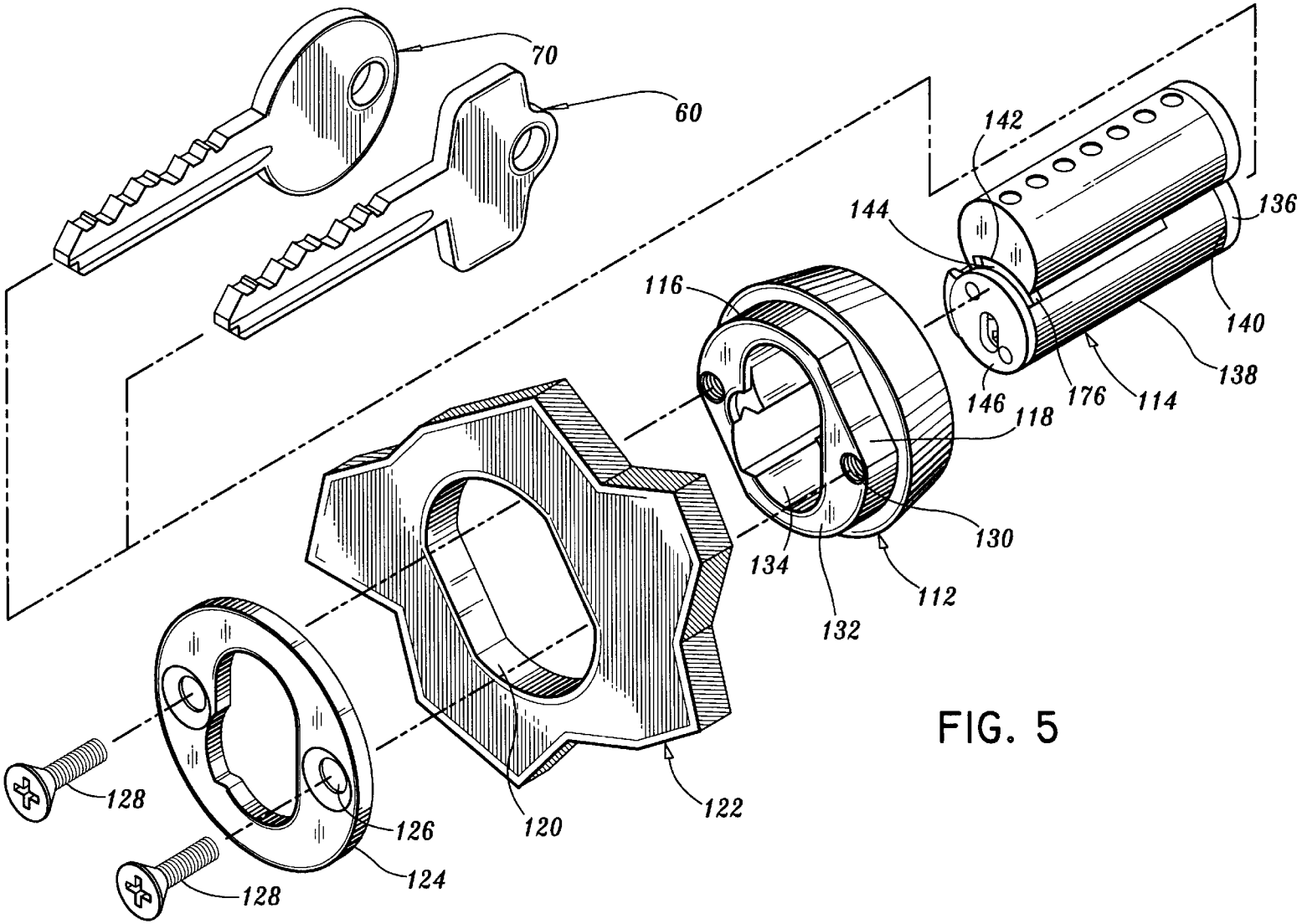
FIG. 5 is a perspective view with parts separated of the sliding door lock assembly shown in FIG. 3 including the sliding door and the securement assembly for securing the sliding door lock assembly to the sliding door.

Referring also to FIGS. 4 and 5, lock housing 112 includes a cylindrical portion 116 having a pair of flats 118. Cylindrical portion 116 is configured to be received within a correspondingly shaped opening 120 formed in a sliding door 122 of an enclosure (not shown), e.g., display cabinet. Flats 118 prevent lock housing 112 from rotating relative to sliding door 122. A clamp plate 124 having holes 126 dimensioned to receive screws 128 functions to secure lock housing 112 to sliding door 122. Screws 128 extend through holes 126 formed in clamp plate 124 and are threadably received in threaded bores 130 formed in a rear face 132 of cylindrical portion 116. A throughbore 134 is formed in lock housing 112 and will be described in further detail below.

Figure 8:
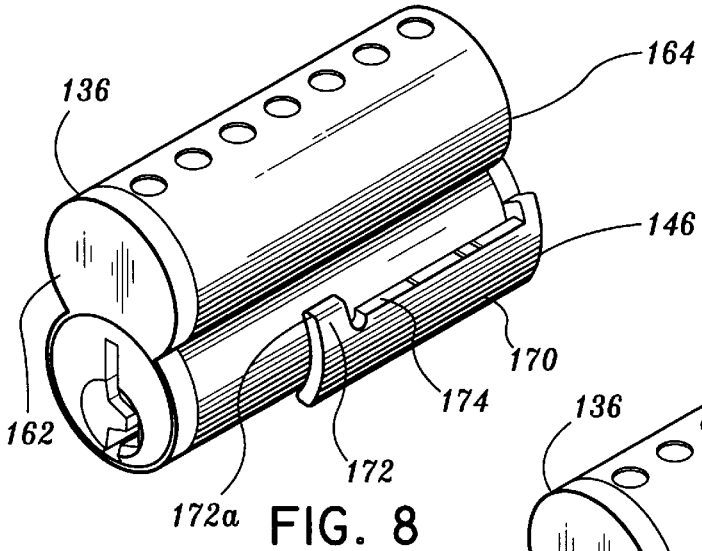
FIG. 8 is a front perspective view of the interchangeable lock core noncaptive key version of the sliding door lock assembly shown in FIG. 3.

Interchangeable lock core 114 includes a face plate 136 and a core body 138 which preferably has a figure-8 configuration, although other configurations are envisioned. Face plate 136 extends outwardly from core body 138 to define a stepped portion 140. A slot 142 is provided in core body 138 to accommodate a rotatable side bar 144. A rotatable retaining member 146 is secured to a rear end of core body 138 and extends along the outer periphery of the core body towards the forward end of the core body. The forward end of core body 138 includes a key slot 139 configured to receive an operating key 60 and a control key 70.

Figure 7:
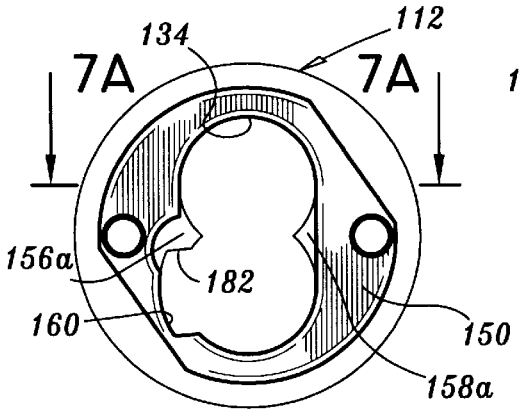
FIG. 7 is a rear end view of the sliding door lock housing shown in FIG. 6.
Figure 6:
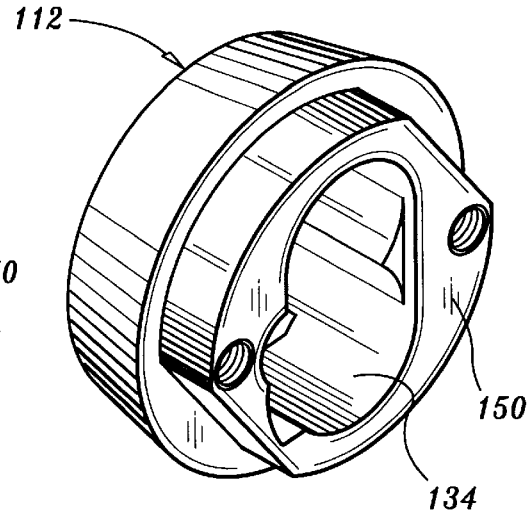
FIG. 6 is a rear perspective view of the sliding door lock housing of the sliding door lock assembly shown in FIG. 3.
Figure 7A:
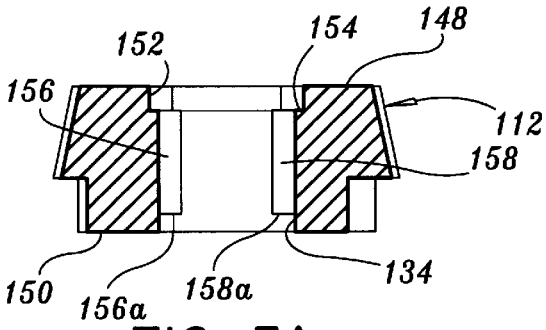
FIG. 7A is a cross-sectional view taken along section line 7A—7A of FIG. 7.

Referring to FIGS. 6–7A, throughbore 134 of lock housing 112 includes a forward end 148 and a rear end 150. An enlarged portion 152 of throughbore 134 includes a shoulder 154. A pair of abutment members 156 and 158 are positioned within throughbore 134. Each abutment member 156 and 158 has an abutment surface 156*a* and 158*a*, respectively, formed thereon. A channel 160 is formed along a sidewall of throughbore 134.

Referring to FIG. 8, interchangeable lock core 114 includes a forward end 162 and a rear end 164. The rear end 164 is dimensioned and configured to be slidably received in throughbore 134 of lock housing 112 (See FIG. 7A). When interchangeable core 114 is fully positioned within throughbore 134 of lock housing 112, face plate 136 of core 114 engages shoulder 154 of throughbore 134 to prevent further insertion of core 114 into housing 112.

Rotatable retaining member 146 includes a body 170 having an engagement member 172 and a groove 174 formed along a longitudinal edge thereof. Engagement member 172 is positioned on core 114 such that when core 114 is fully inserted in housing 112, the forward end 172*a* of engagement member 172 is positioned rearwardly of abutment surface 156*a* formed in throughbore 134. Retaining member 146 is rotatable using either the operating key 60 or the control key 70 (See FIG. 5) to rotate engagement member 172 between a first position spaced from abutment surface 156*a* to a second position located behind abutment surface 156*a*. In the second position of engagement member 172, interchangeable core 114 is prevented from sliding along throughbore 134 by contact between the forward end 172*a* of engagement member 172 and abutment surface 156*a*.

Referring again to FIGS. 4 and 5, rotatable side bar 144 includes an engagement member 176. The engagement member 176 is rotatable using the control key from a first position located within slot 142 of core body 138 to a second position extending from slot 142. In the second position, engagement member 176 is aligned with abutment surface 158*a* (FIG. 7A) such that interchangeable core 144 is slidable along throughbore 134 but is prevented from being removed from throughbore 134 by contact between engagement member 176 and abutment surface 158*a*.

Referring again to FIG. 8, groove 174 on retaining member 146 is dimensioned to extend from abutment surface 156*a* to a position beyond forward end 148 of housing 112 (See FIG. 7A). In operation using the operating key, when retaining member 146 is rotated to permit interchangeable core 114 to be withdrawn from housing 112 to the position in which engagement member 176 of side bar 144 contacts abutment surface 158*a*, groove 174 permits the operating key 60 (FIG. 5) to be counter-rotated a sufficient distance to permit the operating key 60 to be removed from the key slot 139. Using this type of retaining member 146, slide door lock assembly 100 is referred to as a "NON-CAPTIVE" lock assembly because the operating key 60 can be removed from the interchangeable core 114 when the interchangeable core 114 is partially withdrawn from housing 112.

Figure 9:
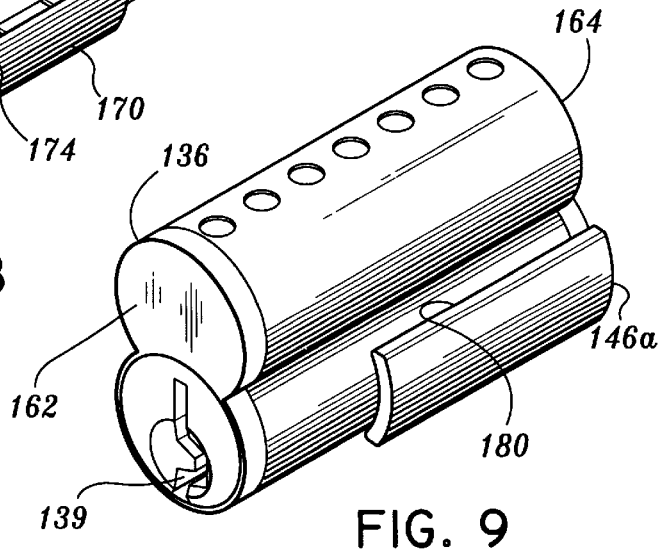
FIG. 9 is a front perspective view of an alternate embodiment of the interchangeable lock core illustrating a captive key version of the sliding door lock assembly.

FIG. 9 illustrates an alternate embodiment of the retaining member 146*a*. Retaining member 146*a* is identical to retaining member 146 in all aspects except it does not include groove 174. Thus, when operating key 60 is rotated in key slot 139 and core 114 is partially withdrawn from housing 112, the operating key cannot be counter-rotated because edge 180 of retaining member 146*a* abuts wall 182 (FIG. 7) of channel 160 to prevent counter-rotation of the operating key. Because counter-rotation of the operating key is prevented, the operating key cannot be removed from key slot 139 when core 114 is partially withdrawn from housing 112. When this type of retaining member 146*a* is used in the lock assembly 100, the lock assembly is referred to as a "CAPTIVE" lock assembly.

Figure 10:
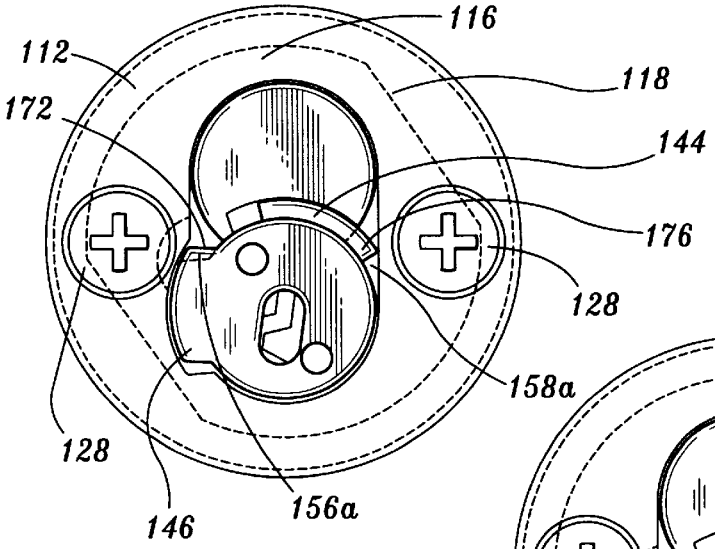
FIG. 10 is a rear end view of the sliding door lock assembly shown in FIG. 3 with the retaining member positioned to prevent relative movement between the sliding door lock housing and the interchangeable core.

FIG. 10 illustrates sliding door lock assembly 100 in a position in which core 114 is fully inserted within housing 112 with engagement member 172 of retaining member 146 positioned behind abutment surface 156*a* of throughbore 134 and engagement member 176 of side bar 144 positioned in alignment with abutment surface 158*a* of throughbore 134.

Figure 11:
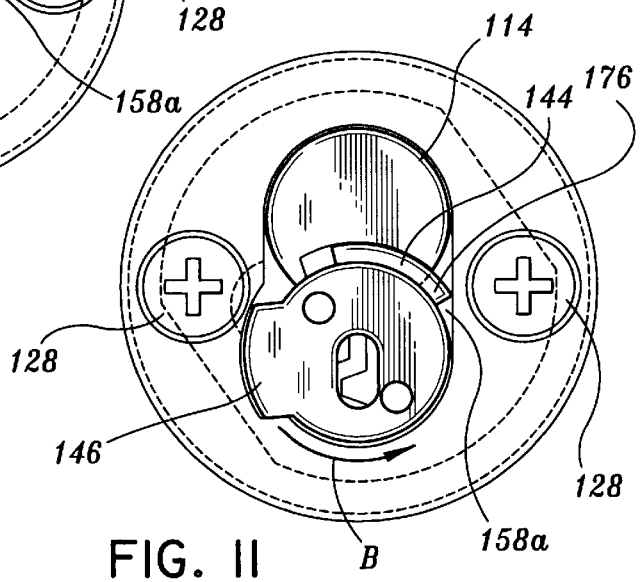
FIG. 11 is a rear end view of the sliding door lock assembly shown in FIG. 3 during movement of the retaining member from a position to prevent relative movement between the interchangeable core and the lock housing and a position to permit relative movement between the interchangeable core and the sliding door lock housing.
Figure 11A:
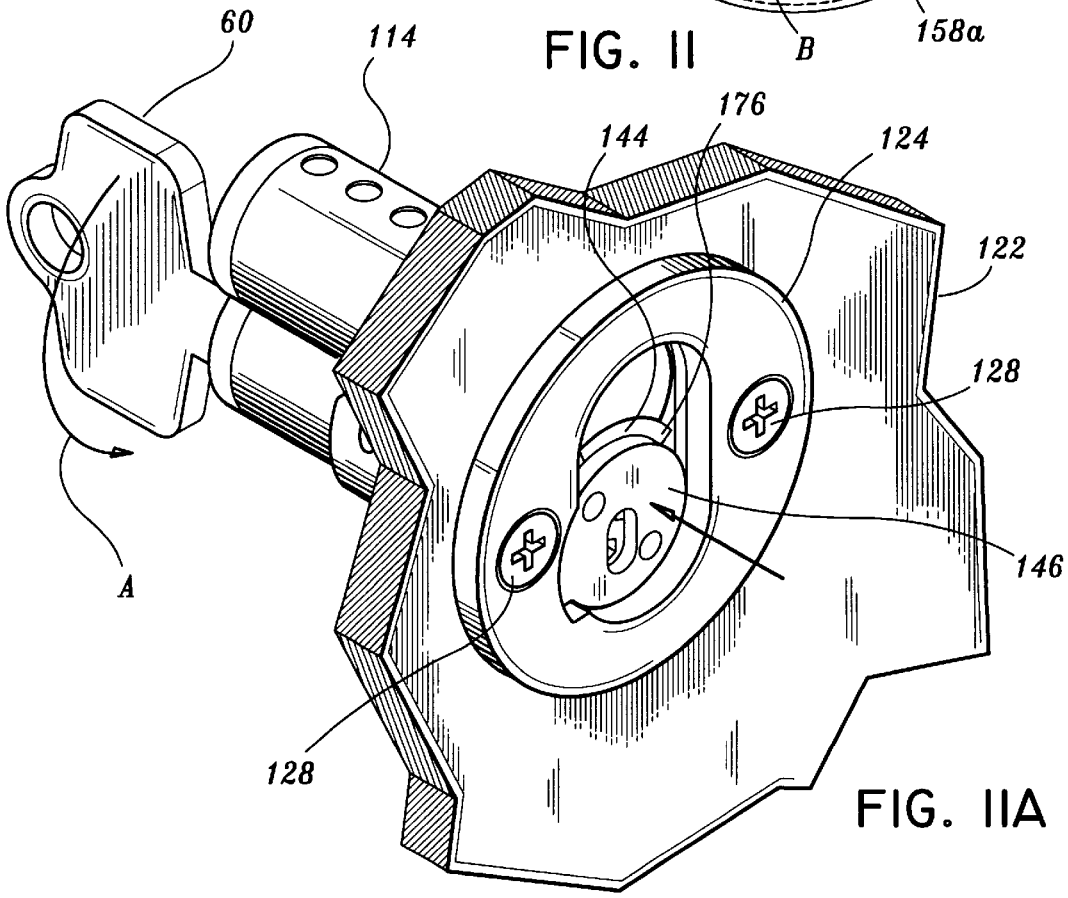
FIG. 11A is a rear end perspective view of the sliding door lock assembly with an operating key inserted in the key slot during movement of the interchangeable core from a position blocking movement of an adjacent sliding door to a position permitting movement of an adjacent sliding door.

In operation, when operating key 60 is inserted into key slot 139 and turned as indicated by arrow "A" in FIG. 11A, retaining member 146 is rotated in the direction indicated by arrow "B" in FIG. 11 to move engagement surface 172 of retaining member 146 out from behind abutment surface 156*a*. In this position, core 114 is free to slide within throughbore 134, as indicated by arrow "B" in FIG. 11A, until engagement member 176 contacts abutment surface 158*a*.

Figure 12:
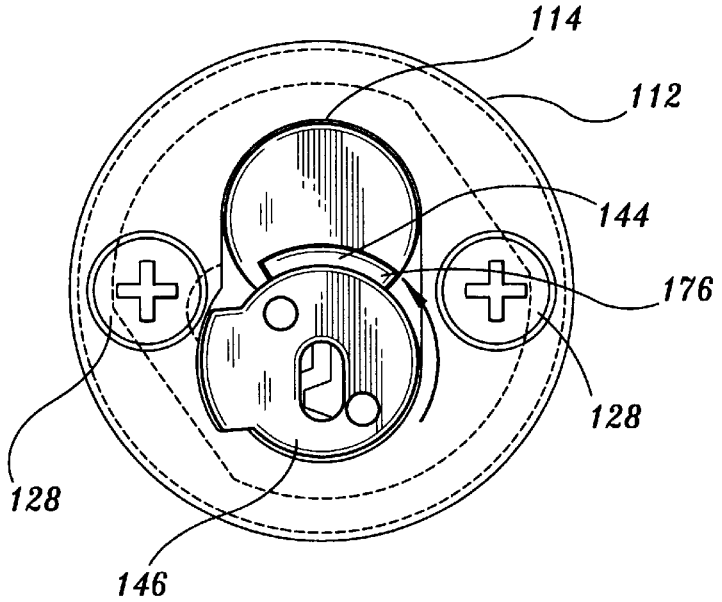
FIG. 12 is a rear end view of the sliding door lock assembly during movement of the retaining member and side bar from a position preventing removal of the interchangeable lock core to a position permitting removal of the interchangeable lock core.
Figure 12A:
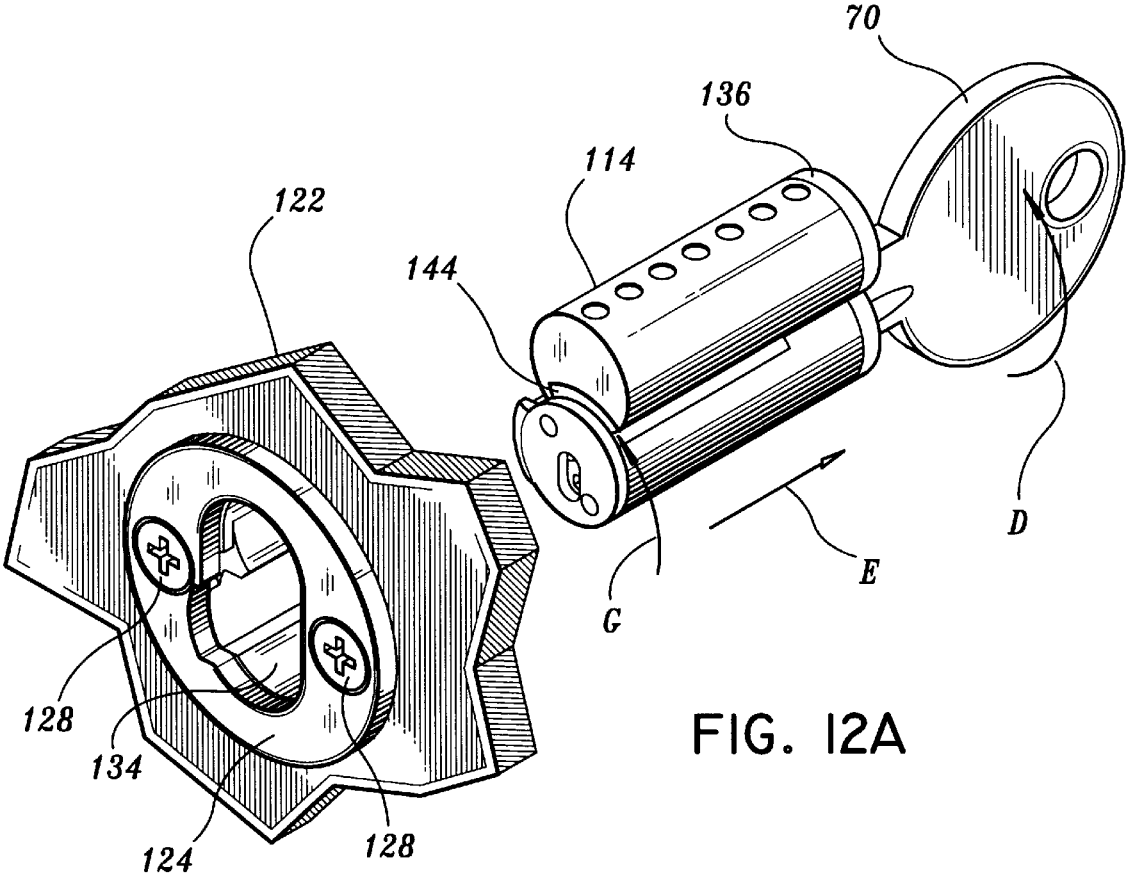
FIG. 12A is a perspective view of the sliding door lock assembly with the control key inserted in the key slot and the interchangeable core being removed from the sliding door lock housing.

Referring to FIGS. 12 and 12A, to remove core 114 from housing 112, control key 70 is inserted into key slot 139 and turned in the direction indicated by arrow "D" in FIG. 12A, moving engagement member 172 of retaining member 146 from behind abutment surface 156*a* and engagement surface 176 of side bar 144 from alignment with abutment surface 158*a* as indicated by arrow "G" in FIG. 12A. In this position, core 114 is freely slidable in the direction indicated by arrow "E" in FIG. 12A, from throughbore 134.

It will be understood that various modifications may be made to the embodiments disclosed herein. For example, the lock core need not have a figure-8 configuration but rather other configurations may be used. Further, the retaining member may also be constructed in a variety of configurations. Therefore, the above description should not be construed as limiting, but merely as exemplifications of preferred embodiments. Those skilled in the art will envision other modifications within the scope and spirit of the claims appended thereto.

What is claimed is:

1. A lock assembly comprising:

a lock housing having a throughbore, the throughbore having first and second abutment surfaces;

a lock core configured and dimensioned to be slidable within the throughbore between a first position located substantially within the throughbore to a second position extending outwardly from the throughbore, the lock core having a key slot configured to receive a control key and an operating key, the lock core further including a first engagement member supported for movement between a first position aligned with the first abutment surface of the lock housing and a second engagement position misaligned with the first abutment surface of the lock housing and a second engagement member supported for movement between a first position aligned with the second abutment surface of the lock housing and a second position misaligned with the second abutment surface, wherein the operating key is configured to move the first engagement member between its first and second positions and the control key is configured to move the first and second engagement members between their respective first and second positions.

2. A lock assembly according to claim 1, further including a clamp plate adapted to be operatively connected to the lock housing to secure the lock housing to a sliding door.

3. A lock assembly according to claim 2, wherein the lock housing further includes a stepped portion configured to be received within a correspondingly shaped opening formed in the sliding door.

4. A lock assembly according to claim 3, wherein the stepped portion is substantially cylindrical and includes at least one flattened surface to prevent relative rotation between the lock housing and the sliding door.

5. A lock assembly according to claim 1, wherein the lock core has a proximal end and a distal end, the key slot having an opening formed in the distal end of the lock core.

6. A lock assembly according to claim 5, wherein the lock core has a figure-eight configuration.

7. A lock assembly according to claim 1, wherein the first engagement member is rotatably supported on the lock core.

8. A lock assembly according to claim 7, wherein the first engagement member is positioned on the lock core such that when the lock core is in its first position substantially within the throughbore, the engagement member is movable from the first to the second position into alignment with the first abutment surface to prevent movement of the lock core to the second position extending outwardly from the throughbore.

9. A lock assembly according to claim 8, wherein when the second engagement member is in its first position on the lock core, the lock core is movable between its first and second positions but is prevented from being removed from the throughbore by engagement between the second engagement member and the second abutment surface, wherein the second engagement member is movable to its second position to facilitate removal of the lock core from the lock housing.

10. A lock assembly according to claim 1, wherein the second engagement member is rotatably supported on the lock core.

11. A lock assembly according to claim 1, wherein when the second engagement member is in its first position on the lock core, the lock core is movable between its first and second positions but is prevented from being removed from the throughbore by engagement between the second engagement member and the second abutment surface, wherein the second engagement member is movable to its second position to facilitate removal of the lock core from the lock housing.

12. A lock assembly comprising:

a lock housing having a throughbore having first and second abutment surfaces; and a lock core having a key slot and being configured and dimensioned to be slidably positioned within the throughbore, the lock core having first and second movable engagement members;

wherein the key slot is configured to receive an operating key and a control key, the operating key being operable to move the first engagement member between a first position aligned with the first abutment member and a second position misaligned with the first abutment surface, and the control key being operable to move the second engagement member between a first position aligned with the second abutment member and a second position misaligned with the second abutment member and to simultaneously move the first engagement member between its first and second positions.

13. A lock assembly according to claim 12, further including a clamp plate adapted to be operatively connected to the lock housing to secure the lock housing to a sliding door.

14. A lock assembly according to claim 13, wherein the lock housing further includes a stepped portion configured to be received within a correspondingly shaped opening formed in the sliding door.

15. A lock assembly according to claim 14, wherein the stepped portion is substantially cylindrical and includes at least one flattened surface which prevents relative rotation between the lock housing and the sliding door.

* * * * *